United States Patent [19]

Bravo

[11] 4,341,326

[45] Jul. 27, 1982

[54] GASOLINE PUMP RESET LEVER LOCK APPARATUS

[76] Inventor: Sergio M. Bravo, 1823 N. Hill Dr., So. Pasadena, Calif. 91030

[21] Appl. No.: 118,293

[22] Filed: Feb. 4, 1980

[51] Int. Cl.[3] ..... B67D 5/26

[52] U.S. Cl. ..... 222/32; 235/144 D

[58] Field of Search ..... 222/32, 33, 34, 35; 235/94 R, 94 A, 144 D, 144 S

[56] References Cited

U.S. PATENT DOCUMENTS

| | | | |
|---|---|---|---|
| 2,311,905 | 2/1943 | Loder | 222/35 |
| 2,742,186 | 4/1956 | Mitnik | 222/35 X |
| 3,008,608 | 11/1961 | Wilson et al. | 222/35 |
| 3,021,982 | 2/1962 | Robinson, Jr. | 222/35 X |
| 3,367,537 | 2/1968 | Robinson et al. | 222/33 |

*Primary Examiner*—Robert J. Spar
*Assistant Examiner*—Edward M. Wacyra
*Attorney, Agent, or Firm*—Nilsson, Robbins, Dalgarn, Berliner, Carson & Wurst

[57] ABSTRACT

A gasoline pump computer reset lock apparatus has a mounting bracket for being attached inside a gasoline pump housing. A bolt or plunger is moveably positioned in a plunger housing attached to the mounting bracket. The plunger is in a locked position when one of its ends is closed against a stop and is in an unlocked position when that one end is spaced back from the stop. A control apparatus is coupled to move the plunger to the locked or unlocked positions. One end of a link is attached to a rotatable crank member. The crank is coupled to a reset lever so that the link moves into the space between the plunger and the stop when the reset lever is rotated. The link is moveably attached to the mounting bracket so that when the plunger is in the locked position against the stop, the forward end of the link encounters the plunger and is prevented from moving into the space. When the plunger is in the unlocked position, the forward end of the link is able to move into the space between the end of the plunger and the stop.

9 Claims, 2 Drawing Figures

GASOLINE PUMP RESET LEVER LOCK APPARATUS

BACKGROUND OF THE INVENTION

The present invention relates to lock devices and, in particular, to a device for selectively preventing a gasoline pump computer from being reset.

In recent years, many previously full service gasoline stations have converted to self service type stations where the customer is permitted to turn on the gasoline pump and dispense gasoline into his own vehicle. A serious problem which has accompanied this conversion, however, has been that the gasoline pump computer which registers both the quantity of gasoline and the total cost of that gasoline, can be easily reset without the knowledge of the attendant in the course of dispensing gasoline. Consequently, a customer wishing to steal gasoline would merely have to turn off the gasoline pump, reset the gasoline pump computer and turn the gasoline pump back on again while the attendant was not watching. The total amount of the gasoline sale which would then appear on the gasoline pump would be much smaller than the actual amount of gasoline pumped. Of course the dishonest customer would only pay for the amount registering on the gasoline pump computer.

In order to solve this problem and eliminate substantial losses to individual gasoline station owners, several different mechanisms have been devised. For example, one method of preventing loss has been to remove the reset lever and replace it with a suitable lock mechanism with a key device which is retained by the attendant. Thus, a customer cannot reset the gasoline pump himself but rather must wait for the attendant. Even though this technique greatly reduces thefts, many maintenance difficulties have arisen. These difficulties mainly occur because the reset lever mechanism is so frequently used that the key device wears out in a relatively short time thus requiring frequent and expensive service calls so that repairs can be made. Furthermore, most such devices are not tamper proof and hence do not entirely stop thefts. Finally, this solution to the problem requires that at least one attendant be present to reset the pumps when customers are finished dispensing gasoline.

In order to overcome these problems and to allow one or more gasoline pump computers to be reset from a central location, electromechanical devices have been devised for attachment to the gasoline pump computer. While these devices have proven very satisfactory from the standpoint of preventing theft, these devices have generally been expensive, complex electromechanical devices involving many parts with substantial maintenance problems. Furthermore, such devices can only be used in pump housings having only one gasoline pump because their physical size prevents their use in gasoline pump housings which house two gasoline pump computers.

The present invention overcomes these difficulties by providing a simple, inexpensive and virtually maintenance free device which can be quickly and easily retrofitted into any existing gasoline pump. Specifically, the present invention provides a simple spring loaded bolt or plunger mounted to a mounted bracket. The bracket may be easily attached to a conventional gasoline pump housing with two bolts. A solenoid or other suitable device which is remotely operable is then attached to the plunger to position the plunger in either an unlocked or locked position. A link is then movably coupled to the reset lever axle in the inside of the housing so that when the reset lever axle is rotated by rotating the reset lever, the link moves in an upward direction. The link is attached to the bracket in a position so that when the plunger is in the locked position the end of the link will encounter the side of the plunger and be prevented from moving. On the other hand, if the plunger is retracted to an unlocked position then the link will be freely movable.

SUMMARY OF THE INVENTION

The present invention is a fluid pump meter reset lock apparatus for use in a fluid pump assembly such as a gasoline pump. The fluid pump assembly generally comprises a housing, a pump mounted in the housing and a meter or gasoline pump computer apparatus mounted in the housing and interconnected to the pump for measuring both the quantity of fluid pumped by the pump and computing therefrom the cost of that fluid. The fluid pump assembly further has an actuating lever apparatus for turning the pump on and off and a reset lever apparatus having a reset lever and reset axle which is rotatable in response to the rotation of the reset lever, for resetting the meter apparatus. The fluid pump meter reset lock apparatus in accordance with the invention then comprised a mounting bracket for being mounted to the fluid pump assembly and preferably to the fluid pump assembly housing. A plunger apparatus is mounted to the mounting bracket and includes a plunger which is controllably movable between a locked position and an unlocked position. A reciprocating link member is next provided having a leg portion which is movably attached to the mounting bracket, and a base portion which is attached to one end of the leg portion. The other end of the leg portion is positioned for engaging the plunger to prevent movement of the link only when the plunger is in the locked position. Finally, a rotatable crank member having a first end which is fixed to the reset axle, whereby the crank member is rotated when the reset lever is rotated, has a second end which is rotatably attached to the base portion of the reciprocating link. The reciprocating link is then mounted to the mounting bracket in a position so that the plunger apparatus prevents the reciprocating link from moving and hence prevents the reset lever from being rotated to reset the pump meter when the plunger is in the locked position.

The fluid pump meter reset lock apparatus of the invention further comprises a means for moving the plunger which includes a solenoid apparatus interconnected to the plunger. A switch means is interconnected between the solenoid apparatus and the power source for selectively interconnecting the solenoid to the power source. Finally, a spring is provided in a plunger housing to maintain the plunger in the normally locked position when the power source is disconnected from the solenoid apparatus by opening the switch.

In one embodiment, the switch means is coupled to be manually closed from a central location. The switch apparatus will then remain closed until either the pump is turned on or the reset lever is rotated to reset the gasoline pump computer.

Alternatively, the switch may be interconnected so that it is both manually closed and manually opened by depressing an appropriate switch at the central location.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

Figures 1, 2:
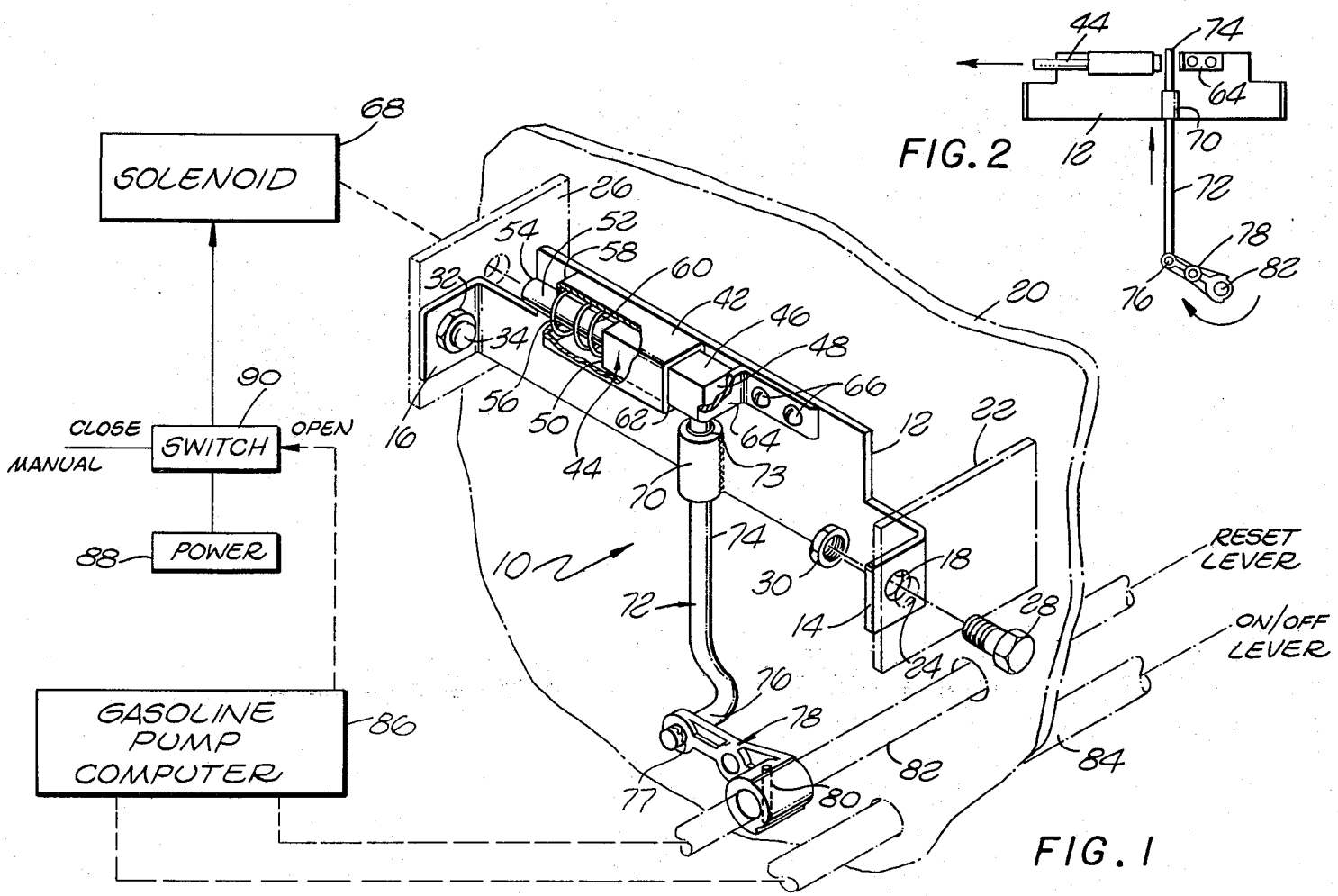
FIG. 1 is a partial cut away pictorial and partial schematic view showing the present invention.
FIG. 2 is a simplified plan view of the invention illustrating its operation.

A pump computer reset lock apparatus 10 in accordance with the present invention is particularly useful as a retrofit device in a conventional gasoline pump device common in most gasoline stations. Such gasoline pump assemblies generally include a pump housing 20 in the interior of which is positioned a fluid pump meter 86 which is generally called the gasoline pump computer. The pump housing 20 also contains the pump, valves, and any other components (not shown) necessary for the proper operating of the pump assembly.

Such conventional gasoline pump assemblies generally operate in the following manner: Initially a reset axle 82 is rotated by rotating a reset lever on the side of the pump housing 20 to clear the gasoline pump computer 86 so that the cost and quality of the prior sale is erased and the quantity meter and the cost meter reset to zero. The gasoline pump (not shown) is then turned on by a rotation of the on-off axle 84 which results when the on-off lever is rotated. After the on-off axle 84 has been rotated and the gasoline pump turned on, gasoline is still not dispensed until the gasoline pump operator releases a valve on the nozzle affixed to the end of a gasoline hose (not shown). In most such conventional gasoline pump devices, the gasoline pump computer 86 will prevent rotation of the on-off axle from the off to the on position if the gasoline pump computer has not been reset by the rotation of the reset axle 82.

As previously discussed, the advent of self-service gasoline stations has enabled persons to initially reset the gasoline pump computer 86 by rotating the reset axle 82, and thereafter rotate the on-off axle 84 to turn the pump on. A quantity of gasoline may then be dispensed by opening the nozzle valve on the end of the hose (not shown). After dispensing an amount of gasoline, the operator can accomplish a theft of gasoline by merely turning the on-off lever to turn off the gasoline pump, rotating the reset lever to reset the gasoline pump computer and then turning the pump on again by rotating the on-off lever to the on position and continuing to dispense gasoline through the nozzle into vehicle. The gasoline station attendant would thus be unaware of the initial amount of gasoline pumped and the customer would pay for less than all of the gasoline dispensed.

The computer reset lock apparatus 10 in accordance with the invention eliminates the problem of theft by providing a apparatus which prevents the reset axle 82 from being rotated after the pump has been turned off.

More specifically, the computer reset lock apparatus 10 comprises a mounting bracket 12 having a first mounting flange 14 on one end and a second mounting flange 16 on a second end of the mounting bracket 12 remote from the first mounting flange 14. The mounting bracket 12 is then positioned between a first mounting flange 22 which is attached to the pump housing 20 and a second mounting 26 also attached to the pump housing 20.

The mounting bracket 112 may be attached to the first and second mounting flanges 22 and 26 in any suitable manner. However, in the preferred embodiment the mounting bracket 12 is attached by a pair of bolts and attaching nuts. Specifically, an orifice 18 is provided through the bracket mounting flange 14 and an orifice 24 is provided through the mounting flange 22. The orifices 18 and 24 are then juxtaposed and a bolt 28 inserted therethrough. A nut 30 is screwed onto the end of the bolt 28 to attach the mounting flange 14 to the mounting flange 22.

In a similar manner, a second bracket mounting flange 16 and a second mounting flange 26 are each provided with orifices therethrough. A nut 32 is then attached to the end of a bolt 34 extending through the juxtaposed orifices (not shown) through the mounting flanges 16 and 26.

It will appreciated that in most pump housings, the first mounting flange 22 and the second mounting flange 26 are already in place and the mounting bracket 12 and the associated computer reset lock apparatus 10 may be attached by merely using the two bolts 28 and 34.

In accordance with the invention, the computer reset lock apparatus 10 comprises a housing 42 which is affixed by welding or any other suitable means to the mounting bracket 12. A bolt device or plunger 44 is then positioned in the interior of the housing 42. In one embodiment, the plunger 44 is a unitary member having a first section 46 with an exterior end 48 which extends beyond a first end 62 of the housing 42. The plunger 44 also has an interior end 50 positioned in the interior of the housing 42.

The plunger 44 further includes a second section 52 which extends from the interior end 50 of the first section 46 through an orifice 56 in a second end 58 of the housing 42. The second section has an exterior end 54 which is outside the end 58 of the housing 42. In the preferred embodiment, the cross-sectional shape of the first section 46 is different from the cross-sectional shape of the second section 52 in such a way that the interior end 50 will have a retaining surface or edge portion facing the second end 58 of the plunger housing 42. In such an arrangement, a spring 60 can be positioned between the interior end of 50 of the first section 46 of the plunger 44 and the interior surface of the second end 58 of the housing 42. Thus, if the spring 60 is a compression spring, the exterior end 48 of the plunger 44 will be thrust outward away from the housing 42 unless the exterior end 54 of the plunger 44 is pulled by appropriate means such as that to be hereinafter described.

A stop 64 is also attached to the mounting bracket 12 by any appropriate means such as the stop mounting screws 66. The stop 64 is juxtaposed in front of but spaced apart from the first end 62 of the housing 42. Thus, the spring 60 will force the plunger 44 outwardly until the end of the plunger 48 comes in contact with the face of the stop 64. When the exterior end 48 of the plunger 44 is in contact with the face of the stop 64, the computer reset lock apparatus will be in the locked configuration.

The reset lever lock apparatus 10 further comprises a reciprocating link member 72 which in the illustrated embodiment is generally L-shaped having a base 76 and leg 74. The leg 74 of reciprocating link member 72 is positioned to extend through an orifice 73 in a link guide 70 which is affixed by welding or any other suitable means to the mounting bracket 12. The base 76 extends through an orifice 77 in one end of a rotatable crank member 78 which is fixed at its other end to the reset axle 82 to be rotated thereby. In one embodiment, the rotatable crank member 78 has a cylindrical attachment portion at its other end through which the reset axle 82 extends. A suitable pin 80 may be inserted through juxtaposed orifices through the cylindrical attachment portion and the reset axle 82 to fix the rotatable crank member 78 to the reset axle 82.

The computer reset lock apparatus 10 finally includes suitable means for moving the plunger 44 longitudinally in the housing 42 so that the exterior end 48 of the plunger 44 can be selectively spaced from the plunger stop 64 so that the leg 74 of the reciprocating link member 72 can be translationally moved into the space between the exterior end 48 of the plunger 44 and the face of the stop 64.

In one embodiment, the means for moving the plunger 44 into the unlocked position with the exterior end 48 of the plunger 44 spaced from the stop 64, comprises a suitable solenoid 68 which is interconnected by any suitable linkage apparatus to the exterior end 54 of the second section 52 of the plunger 44. The exterior end 54 may be connected directly to the solenoid 68 by a suitable rigid link (not shown). However, because of space limiations inside the pump housing 20, a suitable cable linkage may be attached between the exterior end 54 and the moveable core of the solenoid 68.

A switch device 90 is then interconnected between a power source 88 and the solenoid 68 in the conventional manner. The switch 90 may be of any suitable type but preferably is of a type which may be closed manually from a remote location and will remain closed until opened. Thus, an operator in a central location will be provided with a suitable switch, or other device (not shown) which when depressed closes the switch 90 to allow power to be supplied to the solenoid 68. When power is supplied to the solenoid 68 a magnetic field is created which moves a core portion in or out of an interior location. The core of the solenoid is coupled to the exterior end 54 of the plunger 44 so that when the solenoid core moves, the exterior end 48 of the plunger 44 also moves into a spaced relationship relative to the plunger stop 64.

In the preferred embodiment, the switch 90 will be opened either mechanically or electrically when the on-off lever is rotated to turn the gasoline pump on. Alternatively, the switch 90 can be coupled to be opened whenever the reset lever is rotated to reset the gasoline pump computer 86. In either of the above embodiments, the switch 90 is closed to actuate the solenoid 68 to move the plunger 44 into an unlocked position when a switch or other suitable device is depressed by an attendant at a remote location. Thereafter, the switch 90 remains closed with power from the power supply 88 being continuously applied to the solenoid 68 to maintain the plunger 44 in the unlocked position until either the reset lever is rotated to reset the gasoline pump computer 86 or the on-off lever is rotated to the on position. When the switch 90 is opened, the power from the power supply 88 is no longer supplied to the solenoid 68 and the spring 60 acts to force the plunger 44 into the locked position with its exterior end 48 positioned against the stop 64.

In still another alternative embodiment, the switch 90 may simply be a manually operated switch in a remote location so that when an attendant in a remote location depresses the switch 90 the plunger 44 is retracted into the plunger housing 42 and when the operator releases or is no longer pressing the switch 90, the switch 90 is opened and the plunger 44 returns to its normally locked position with its exterior end 48 against the stop 64.

Of course, it will be appreciated that any other suitable switching mechanism may be utilized in accordance with the invention and that the above switching means are given by way of illustration only.

Referring now to FIG. 2, a simplified schematic illustrating the operation of the present invention is shown. Assuming that the reset axle 82 must be rotated in a clockwise direction to reset the gasoline pump computer 86, it can be seen that when the reset axle 82 is rotated, the rotatable crank member 78, which is attached to the reset axle 82, also rotates in a clockwise direction. As the rotatable crank member 78 rotates, the reciprocating link member 72 is forced to move upward and, if unimpeded, moves into the space between the plunger 44 and the stop 64. However, if the plunger 44 is in locked or unretracted position, the end 48 of the plunger 44 will be in contact with the stop 64 and the end of the reciprocating link member 72 will consequently make contact with the plunger 44. Rotation of the reset axle 82 will thus be prevented until the plunger 44 is retracted to provide a space between the one end 48 of the plunger 44 and the stop 64.

In accordance with the above description, it will be appreciated that the end of the rotatable crank 78 is rotatably attached to the base 76 of the reciprocating link member so that as the rotatable crank member 78 rotates with the reset axle 82, the end of the rotatable crank member 78 attach to the base 76 will rotate relative to the base 76. Thus, the rotational motion of the rotatable member 78 will be converted into reciprocating motion to thus cause the reciprocating link member 72 to move up and down as the rotatable member 78 rotates through a small angle.

In addition, it will be further appreciated that the orifice 73 through the link guide 70 will preferably be of a diameter somewhat larger than the diameter of the reciprocating link member 72 to allow for a small amount of side-to-side movement which results as a consequence of rotating the crank member 78.

Although particular embodiments of the invention have been shown and described, it will be obvious to those skilled in the art that changes and modifications may be made without departing from the invention in its broader aspects, and therefore, the aim in the appended claims is the cover all such changes and modifications as fall within the true spirit and scope of the invention.

What is claimed is:

1. A fluid pump meter reset lock apparatus for use in a fluid pump assembly having a housing, a pump mounted in the housing, a meter apparatus mounted in the housing and interconnected to the pump for measuring the quantity of fluid pumped by the pump, an actuating lever apparatus for turning the pump on and off, and a reset lever apparatus having a reset lever and a reset axle rotatable in response to rotation of the reset lever for resetting the meter apparatus, the fluid pump meter reset lock apparatus comprising:

a mounting bracket for being mounted within the fluid pump assembly;

a plunger apparatus mounted to the mounting bracket having a plunger which is controllably moveable to a locked position and to an unlocked position;

a reciprocating link member having a leg portion movably attached to the mounting bracket and a base portion attached to one end of the leg portion, the other end of the leg portion positioned for encountering the plunger only when the plunger is in the locked position; and a rotatable crank member having a first end fixed to the reset axle whereby the crank member is rotated when the reset lever is rotated and further having a second end rotably attached to the base portion of the reciprocating link member whereby the plunger apparatus prevents the reset lever from being rotated to reset the pump meter when the plunger is in the locked position.

2. The fluid pump meter reset lock apparatus of claim 1 further comprising means coupled to the plunger for moving the plunger to the locked and to the unlocked position.

3. The fluid pump meter reset lock apparatus of claim 2 wherein the means for moving the plunger comprises:

a solenoid apparatus interconnected to the plunger;

a power source for energizing the solenoid to move the plunger to the unlocked position;

switch means for selectively interconnecting the solenoid to the power source for being energized thereby;

and means for positioning and maintaining the plunger in the normally locked position when the power source is electrically disconnected from the solenoid.

4. The fluid pump meter reset lock apparatus of claim 3 wherein the switch means is coupled to the actuating lever apparatus for enabling the plunger to be positioned in the locked position when the pump is turned on, and the switch means is further coupled for being manually operable for enabling the plunger to be positioned in the unlocked position.

5. The fluid pump meter reset lock apparatus of claim 3 wherein the switch means is coupled to the reset lever apparatus for enabling the plunger to be positioned in the locked position when the pump meter is reset by the reset lever.

6. The fluid pump meter reset lock apparatus for claim 3 wherein the switch means is manually operable for enabling the plunger to be positioned in either the locked or the unlocked position.

7. The fluid pump meter reset lock apparatus of claims 3, 4, 5 or 6 wherein the plunger is an elongated member having an elongated portion with an interior end and an exterior end and further having a second elongated portion with an interior end and an exterior end wherein the plunger apparatus further comprises:

a plunger housing attached to the mounting bracket having a first end through which the first elongated portion extends and a second end through which the second elongated portion extends, the interior ends of the first and second elongated portions coupled in an interior region of the plunger housing;

a spring positioned in the interior of the plunger housing around the second elongated portion of the plunger between the second end of the housing and the interior end of the first elongated portion; and a stop fixed to the mounting bracket and juxtaposed adjacent the first end of the plunger housing for being contacted by the exterior end of the first elongated portion of the plunger when the plunger is in the locked position.

8. A fluid pump meter reset lock apparatus for a pump apparatus having a housing and a reset lever comprising:

a plunger apparatus having a plunger controllably moveable into a locked position or an unlocked position; and a linearly reciprocating link member having a first end coupled to the reset lever whereby the link member is linearly reciprocated in response to rotation of the reset lever, the link member further having a second end, remote from the first end, juxtaposed adjacent the plunger whereby the second end of the link member abuts against the plunger to prevent rotation of the reset lever only when the plunger is in the locked position.

9. The fluid pump meter lock apparatus of claim 8 further comprising:

means for selectively moving the plunger into the locked or unlocked position.

* * * * *